US008083569B2

(12) United States Patent
Sotereanos et al.

(10) Patent No.: US 8,083,569 B2
(45) Date of Patent: Dec. 27, 2011

(54) REMOTELY CONTROLLED VEHICLE

(76) Inventors: Nicholas Sotereanos, McKeesport, PA (US); George Sotereanos, McKeesport, PA (US)

( * ) Notice: Subject to any disclaimer, the term of this patent is extended or adjusted under 35 U.S.C. 154(b) by 1669 days.

(21) Appl. No.: 11/348,110

(22) Filed: Feb. 6, 2006

(65) Prior Publication Data

US 2006/0178085 A1 Aug. 10, 2006

Related U.S. Application Data

(60) Provisional application No. 60/650,457, filed on Feb. 4, 2005.

(51) Int. Cl.
*A63H 30/04* (2006.01)

(52) U.S. Cl. ..... 446/456; 446/454

(58) Field of Classification Search ..... 124/56
See application file for complete search history.

(56) References Cited

U.S. PATENT DOCUMENTS

| | | | | |
|---|---|---|---|---|
| 2,359,032 | A | 9/1944 | Gott | |
| 3,065,569 | A * | 11/1962 | Nielsen et al. | 446/88 |
| 3,086,465 | A * | 4/1963 | De Montfort | 102/301 |
| 3,139,794 | A | 7/1964 | Barnes, Jr. et al. | |
| 3,229,420 | A * | 1/1966 | Dias | 446/154 |
| 3,417,198 | A | 12/1968 | Loyd | |
| 3,566,742 | A | 3/1971 | Bemiss | |
| 3,711,638 | A | 1/1973 | Davies | |
| 3,777,732 | A | 12/1973 | Holloway et al. | |
| 3,823,847 | A * | 7/1974 | Ware | 222/79 |
| 3,862,584 | A | 1/1975 | Schmidt et al. | |
| 3,869,825 | A * | 3/1975 | Heberlein | 446/433 |
| 3,917,270 | A | 11/1975 | Gothard, Jr. et al. | |
| 4,126,312 | A * | 11/1978 | Kreuzer et al. | 273/359 |
| 4,194,708 | A * | 3/1980 | Tracy et al. | 244/15 |
| 4,222,307 | A | 9/1980 | Roettges et al. | |
| 4,226,292 | A | 10/1980 | Monte et al. | |
| 4,621,562 | A * | 11/1986 | Carr et al. | 89/41.05 |
| 4,635,526 | A * | 1/1987 | Mottana et al. | 89/1.41 |
| 4,773,298 | A * | 9/1988 | Tischer et al. | 89/1.13 |

(Continued)

FOREIGN PATENT DOCUMENTS

DE 3404202 A1 * 5/1987

OTHER PUBLICATIONS

"Armed Robots to March into Battle", Sgt. Lorie Jewell, Army News Service, http://www.defense.gov/transformation/articles/2004-12/ta120604c.html (Dec. 2004).*

(Continued)

*Primary Examiner* — Troy Chambers
(74) *Attorney, Agent, or Firm* — K&L Gates LLP

(57) ABSTRACT

A remotely-controlled vehicle is disclosed. According to various embodiments, the vehicle includes components that may be added to an existing vehicle or added at the time of manufacture. The components include at least one of a pneumatic projectile launcher and a water cannon, a rocket launcher having one or more rockets launchable from the vehicle, at least one video camera system for capturing and transmitting video images, and a controller for controlling the projectile launcher, water cannon, rocket launcher, and video camera system. Each of the one or more rockets may include at least one solid-propellant rocket motor, and each of the one or more video camera systems may include at least one video camera mounted for selective orientation in at least one plane.

14 Claims, 9 Drawing Sheets

U.S. PATENT DOCUMENTS

| | | | | | |
|---|---|---|---|---|---|
| 4,884,137 | A | * | 11/1989 | Hanson et al. | 348/158 |
| 4,884,506 | A | * | 12/1989 | Guerreri | 102/200 |
| 4,932,831 | A | * | 6/1990 | White et al. | 414/732 |
| 4,951,644 | A | * | 8/1990 | Bon | 124/75 |
| 4,993,912 | A | * | 2/1991 | King et al. | 414/729 |
| 5,016,004 | A | | 5/1991 | Funk et al. | |
| 5,022,812 | A | * | 6/1991 | Coughlan et al. | 414/729 |
| 5,100,153 | A | * | 3/1992 | Welte | 273/357 |
| 5,125,668 | A | * | 6/1992 | Welte | 273/357 |
| 5,263,396 | A | * | 11/1993 | Ladan et al. | 89/1.11 |
| 5,295,890 | A | * | 3/1994 | Myers | 446/176 |
| 5,359,576 | A | * | 10/1994 | Bunner et al. | 367/197 |
| 5,460,154 | A | * | 10/1995 | Mattern et al. | 124/56 |
| 5,698,817 | A | * | 12/1997 | Hillenbrand | 114/21.2 |
| 5,708,230 | A | * | 1/1998 | Woodall et al. | 102/402 |
| 5,842,907 | A | * | 12/1998 | Niimura et al. | 446/435 |
| 5,907,117 | A | * | 5/1999 | Persson et al. | 89/1.11 |
| 5,949,015 | A | * | 9/1999 | Smith et al. | 89/41.05 |
| 6,113,343 | A | * | 9/2000 | Goldenberg et al. | 414/729 |
| 6,155,155 | A | * | 12/2000 | Moshier | 89/1.13 |
| 6,269,763 | B1 | * | 8/2001 | Woodland | 114/382 |
| 6,311,681 | B1 | * | 11/2001 | Snyder, Jr. | 124/59 |
| 6,361,393 | B1 | | 3/2002 | Seymour | |
| 6,408,731 | B1 | * | 6/2002 | Elsener | 86/50 |
| 6,532,947 | B1 | * | 3/2003 | Rosa et al. | 124/56 |
| 6,584,881 | B1 | * | 7/2003 | Boudreau et al. | 89/1.804 |
| 6,615,814 | B1 | | 9/2003 | Rice et al. | |
| 6,681,675 | B2 | * | 1/2004 | Miller | 86/50 |
| 6,802,237 | B1 | * | 10/2004 | Jones et al. | 89/1.13 |
| 7,073,749 | B2 | * | 7/2006 | Krill et al. | 244/2 |
| 7,086,318 | B1 | * | 8/2006 | Darnall | 89/1.815 |
| 7,296,503 | B1 | * | 11/2007 | McGrath | 89/1.13 |
| 7,481,694 | B1 | * | 1/2009 | Benbow | 446/454 |
| 7,549,367 | B2 | * | 6/2009 | Hill | 89/136 |
| 2002/0062730 | A1 | * | 5/2002 | Thornton | 86/50 |
| 2003/0089220 | A1 | * | 5/2003 | Boudreau et al. | 89/1.815 |
| 2003/0220044 | A1 | * | 11/2003 | Andrews et al. | 446/268 |
| 2004/0030450 | A1 | | 2/2004 | Solomon | |
| 2004/0216932 | A1 | * | 11/2004 | Giovanetti et al. | 180/9.1 |
| 2005/0016515 | A1 | * | 1/2005 | Arnaud | 124/56 |
| 2006/0050929 | A1 | * | 3/2006 | Rast et al. | 382/103 |
| 2007/0051235 | A1 | * | 3/2007 | Hawkes et al. | 89/37.04 |

OTHER PUBLICATIONS

"What is a teletank?", Alexander Lychagin, http://www.odintsovo.info/news/?id=1683, (Sep. 2004).*

Miniature Wireless Video Camera, available at http://www.spylife.com/vidcam-cmos1.html, accessed Dec. 30, 2004, 1 page.

Kingman Spyder Imagine Specs & Features, available at http://www.spyderzone.net, accessed Dec. 28, 2004, 4 pages.

DuraTrax® Warhead™ ⅛Scale Ready-To-Run 4WD Nitro Monster Truck with Reverse, available at http://www.warheadmt.com, accessed Dec. 27, 2002, 2 pages.

Futuba® 9Z WC2 9-Channel Radio Systems, available at http://www.futaba-rc.com/, accessed Jan. 3, 2005, 4 pages.

Futuba® 9C Computer Systems, available at http://www.futaba-rc.com/radios/futj85.html, accessed Jan. 3, 2005, 3 pages.

* cited by examiner

REMOTELY CONTROLLED VEHICLE

CROSS-REFERENCE TO RELATED APPLICATIONS

This application claims priority under 35 U.S.C. §119 to U.S. provisional patent application Ser. No. 60/650,457, filed Feb. 4, 2005, which is incorporated herein by reference.

BACKGROUND OF THE INVENTION

This application is related, generally and in various embodiments, to remotely controlled vehicles.

Miniature-scale versions of vehicles designed for radio-controlled operation are widely available in toy stores and hobby shops and commonly used by children and adults alike for a variety of entertainment-related activities, including racing and obstacle course navigation. Examples of such vehicles include wheeled vehicles such as cars and trucks, treaded vehicles such as tanks, aircraft, and watercraft such as boats, hovercraft, and submarines. Conventional vehicle features typically include one or more battery-powered motors or combustion engines for propelling the vehicle and one or more electro-mechanical servos for controlling the vehicle's route. An on-board control circuit may control the motors, engines, and servos in accordance with remote control commands received from a control device operated by a user. The control device and the vehicle control circuit may comprise a radio transmitter and receiver, respectively, thus enabling remote operation of the vehicle.

SUMMARY

Although the traditional racing and obstacle course navigation activities may be sufficient entertainment for some users, other users may find those activities lacking. In an age of fast-paced video-game entertainment, more exciting options for radio-controlled vehicles are desired.

The present invention provides additional vehicle features for providing a greater variety of entertainment activities. In addition to entertainment-related uses, the present invention also provides features which equip remote control toy vehicles for applications in surveillance and law enforcement. In particular, the small size of such vehicles and their remote control capabilities makes them well-suited for deployment in locations that would otherwise be impractical or unsafe for a person.

The present invention thus provides a remotely-controlled vehicle with components for enhancing the vehicle mounted thereto. The components include at least one and preferably two, of a projectile launcher, a water cannon, a rocket launcher and a camera system. A controller is provided to operate the vehicle from a remote location. In one embodiment, a safety interlock system is provided fro disabling at least one of the enhancing components unless predetermined conditions are detected.

In another embodiment, the rocket launcher is mounted to the vehicle for movement through at least one plane and has one or more rockets. Each rocket includes at least one solid-propellant rocket motor.

The projectile launcher may also be mounted to the vehicle for movement through at least one plane. The projectile launcher may be rotationally mounted to the vehicle to permit rotation about an axis of rotation so the an item to be launched may be directed anywhere within a 360° angle. The projectile launcher is preferably a pneumatically powered launcher.

The camera system may include at least one camera, and preferably one video camera system for capturing and transmitting video images.

One embodiment of the remotely-controlled vehicle may be used for surveillance activities. The embodiment includes a system for enabling surveillance of a location of interest from a remote location via a network. The system for enabling surveillance includes a radio-controlled vehicle for movement in the vicinity of the location of interest, a computer at the remote location and a controller for receiving commands from the computer and transmitting control commands to the vehicle. The radio-controlled vehicle in this embodiment includes one or more video camera systems, which preferably include one or more video cameras for capturing images mounted to the vehicle for selective movement through at least one plane and one or more transmitters for transmitting the captured video images to the computer. The vehicle additionally includes a receiver positioned on the vehicle for receiving control commands. The computer communicates control commands to the controller via the network for controlling the speed and direction of the vehicle and the orientation of the video camera.

DESCRIPTION OF THE FIGURES

Various embodiments of the present invention will be described by way of example in conjunction with the following figures, wherein.

DETAILED DESCRIPTION

Figure 1:
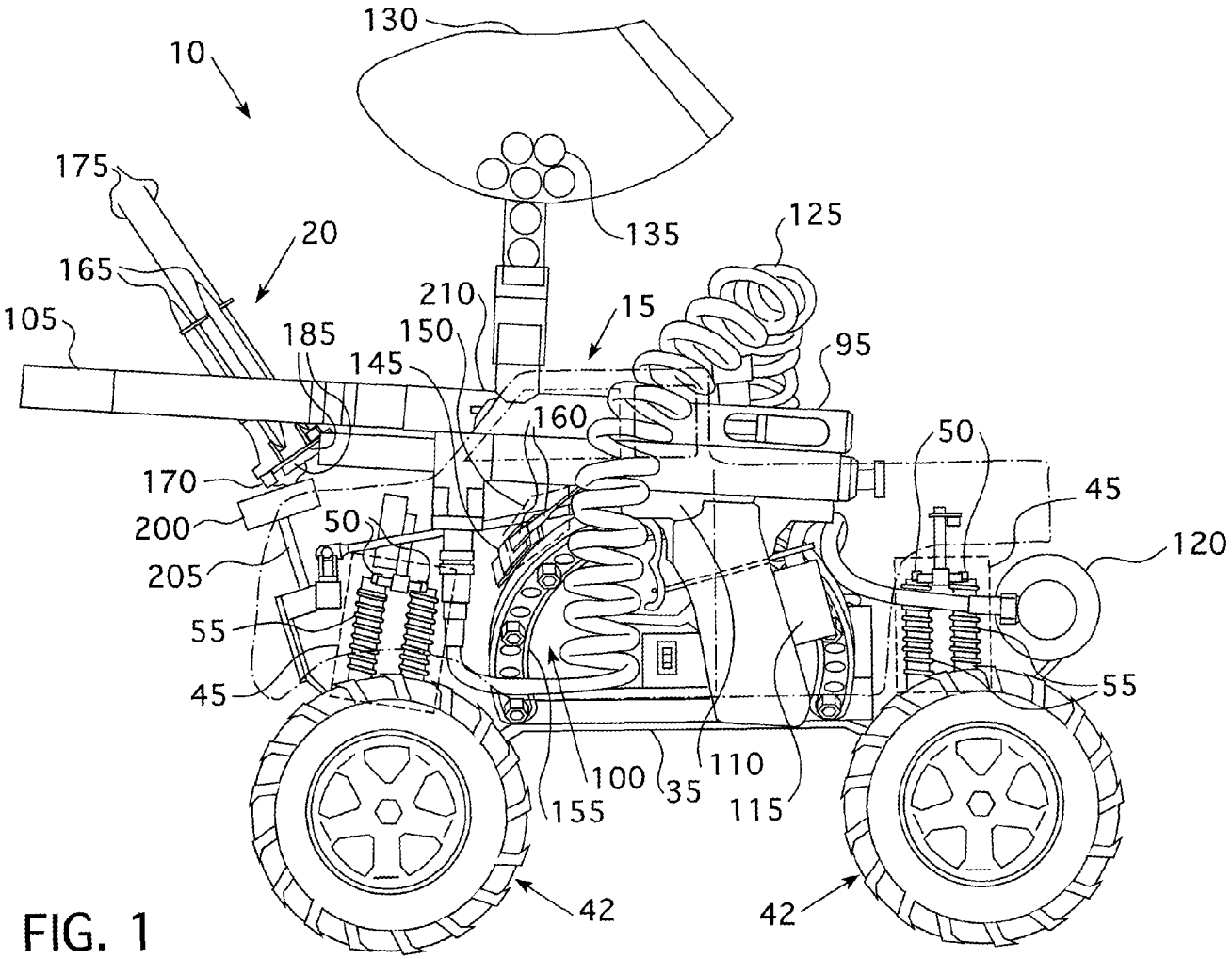
FIG. 1 is a right side elevational view of a remotely-controlled vehicle according to various embodiments of the present invention.
Figure 2:
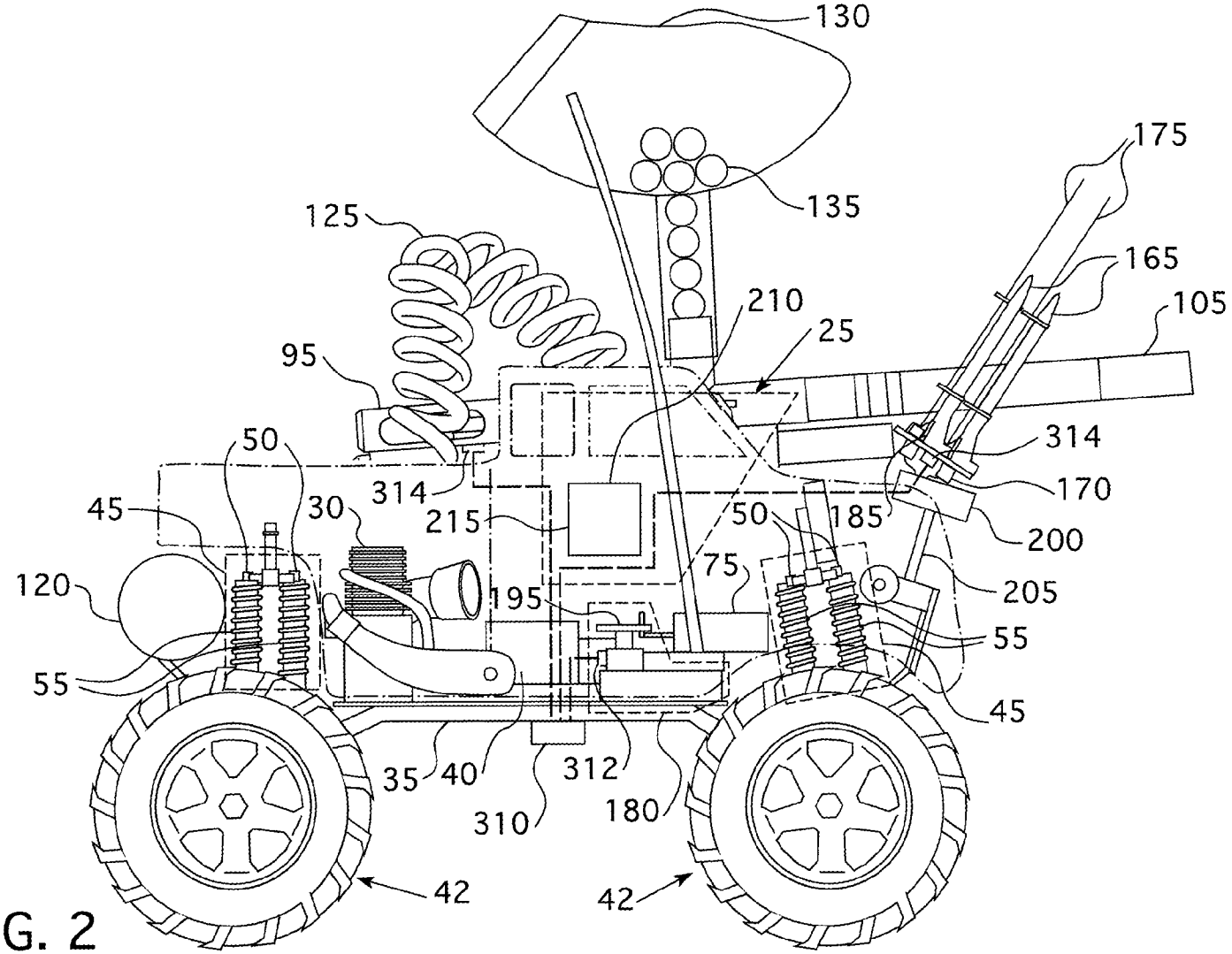
FIG. 2 is a left side elevational view thereof.
Figure 3:
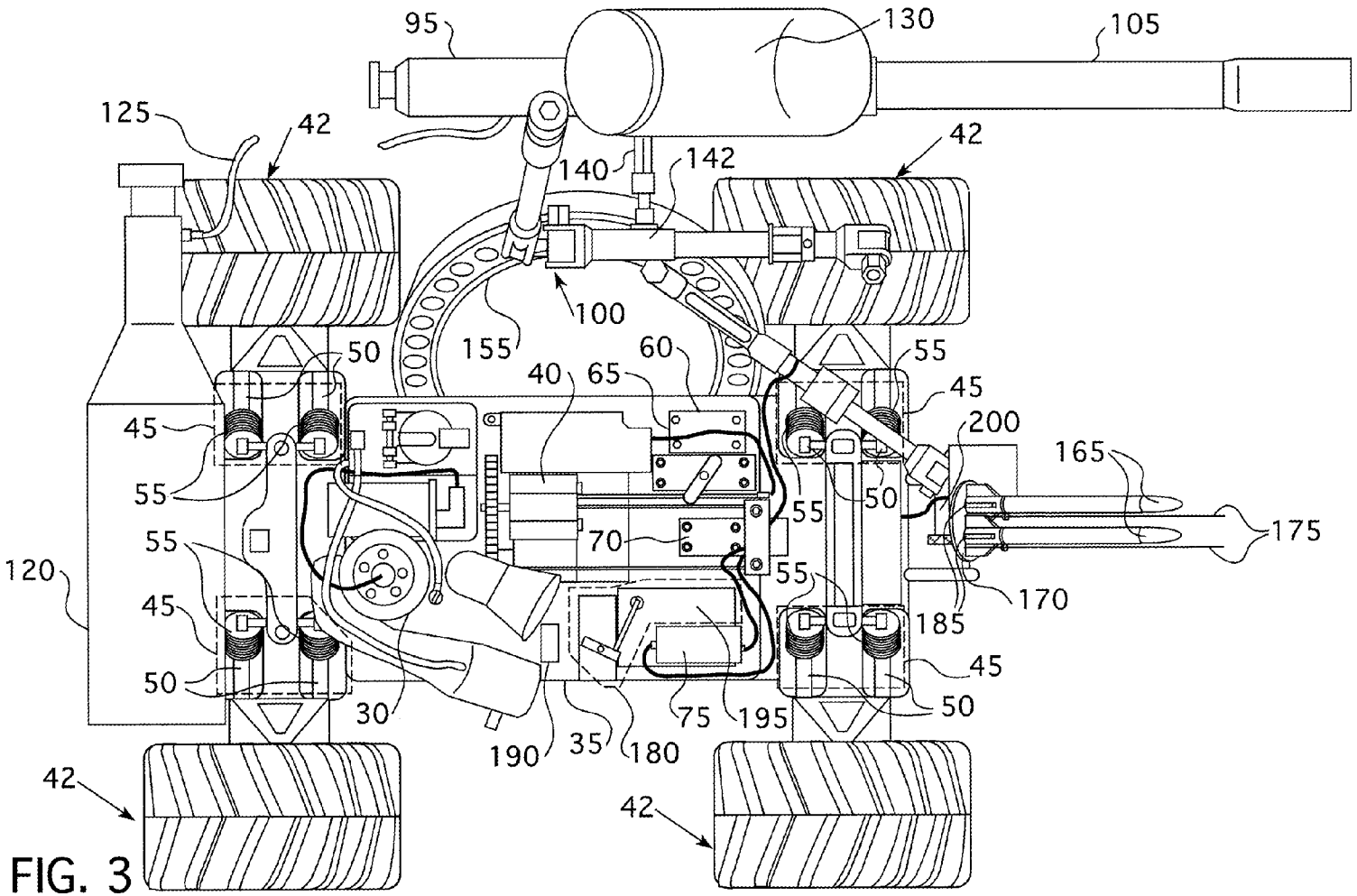
FIG. 3 is a top view thereof.

FIGS. 1-3 illustrate right, left, and top views, respectively, of a remotely-controlled (RC) vehicle 10 according to various embodiments of the present invention. According to such embodiments, the RC vehicle 10 may comprise an "off-the-shelf" RC toy vehicle such as, for example, an four-wheel drive RC toy truck available from the Traxxas Corporation of Plano, Tex. According to other embodiments, the RC vehicle 10 may be assembled from a commercially-available RC vehicle kit or custom-built using commercially available and/or custom-fabricated RC vehicle expansion components. Although the RC vehicle 10 is depicted in FIGS. 1-3 as comprising an RC toy truck, it can be appreciated that other types of RC toy vehicles such as, for example, cars, tanks, hovercraft, boats, and aircraft may also be used. The RC vehicle 10 may further comprise various types of armament systems such as, for example, a pneumatic projectile launcher system 15 and a rocket launcher system 20. The RC vehicle 10 may further comprise a wireless camera system 25.

As shown in FIGS. 2-3, the RC vehicle 10 may comprise a combustion engine 30 as its means of propulsion. The combustion engine 30 may be, for example, any of a variety of commercially-available combustion engines typically used in hobby applications and powered by a fuel mixture comprising one or more of methanol, nitromethane, and oil. The engine 30 may be mounted on a chassis 35 and coupled to a transmission 40 for distributing mechanical energy to the vehicle's drive train (not shown) and wheels 42. According to other embodiments, the RC vehicle 10 may be propelled by an electric motor powered by rechargeable batteries. To support the weight of the various components comprising the RC vehicle 10 and to and ensure its stabile operation, the RC vehicle 10 may further comprise a heavy-duty suspension system 45. The suspension system 45 may include one or more heavy-duty shock absorbers 50 and corresponding support springs 55.

The RC vehicle 10 may further comprise one or more electromechanical servos 60, 65, 70 for controlling movement of the RC vehicle 10 during operation. The servos 60, 65, 70 may include one or more of a steering servo 60, a braking and throttling servo 65, and a transmission control servo 70. Control of the servos 60, 65, 70 and other vehicle features may be provided by a control circuit 75. The control circuit 75 may include one or more receivers for receiving command signals transmitted on one or more radio channels. Generally, the number of radio channels utilized by the one or more receivers corresponds to the number of vehicle features to be controlled. The servos 60, 65, 70, for example, may represent three separately controlled features. Thus, for example, where there are eight vehicle features to be controlled, the control circuit 75 may comprise a single eight-channel receiver. Alternatively, two four-channel receivers or four two-channel receivers could be used.

Figure 4:
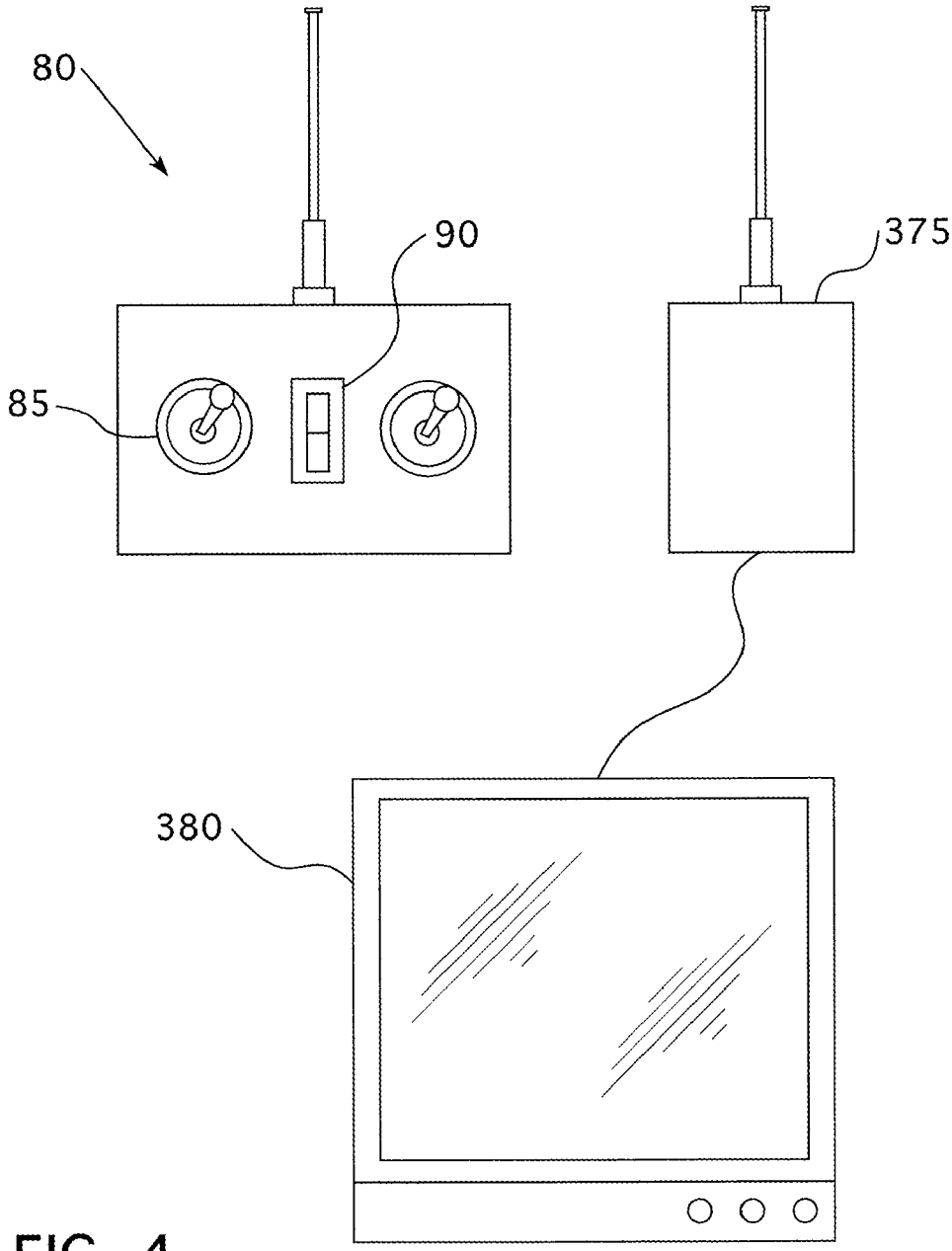
FIG. 4 illustrates a control device, receiver and video screen for operating the remotely-controlled vehicle according to various embodiments of the present invention.

FIG. 4 illustrates a controller, such as a radio control device 80, for operating the RC vehicle 10 according to various embodiments of the present invention. The controller 80 may be a commercially-available radio control device that comprises a transmitter capable of transmitting command signals on radio channels compatible with those utilized by the one or more receivers of the control circuit 75. The controller 80 may further comprise one or more user-manipulable control sticks 85 and/or switches 90 for controlling features of the RC vehicle 10 in the desired manner. For example, the one or more control sticks 85 and switches 90 may be manipulated to control the servos 60, 65, 70 associated with the steering, braking, throttling, and transmission control functions of the RC vehicle 10. In at least one embodiment, the controller 80 may be a programmable radio control device wherein each radio channel corresponding to a controlled feature of the RC vehicle 10 may be assigned to the one or more control sticks 85 and switches 90 in accordance with a control scheme selected by the operator. Such a controller 80 may be, for example, a programmable pulse code modulation (PCM) radio control device available from the Futaba Corporation of America of Schaumburg, Ill.

The pneumatic projectile launcher system 15, as shown in FIGS. 1-3, comprises a pneumatic projectile launcher 95 and a mounting assembly 100 for pivotally affixing the pneumatic projectile launcher 95 to the RC vehicle 10 and for continuously varying the angular trajectory of the pneumatic projectile launcher 95 in at least one of a vertical and a horizontal plane. According to various embodiments, the pneumatic projectile launcher 95 may comprise a commercially-available paintball gun for shooting paint-filled projectiles. The paint-filled projectiles may be, for example, standard paintballs consisting of a colored paint encapsulated in a hard outer shell that is designed to fragment upon impact, thus causing the target to be visibly marked. Alternatively, the paintballs may be filled with a phosphor paint that is generally invisible to the naked eye in normal light. Such paintballs may be used, for example, by law enforcement personnel when it is desirable to place an imperceptible paint marking on a person or other target for later identification with a UV light source.

Because paintballs may not be purchased by or otherwise suitable for use by younger operators of the RC vehicle 10, the pneumatic projectile launcher 95 may be configured to shoot projectiles made from a soft material for reducing the chance of injury or property damage resulting from projectile impact. Such materials may include, for example, foam materials, sponge materials, and soft plastic or cloth materials.

Figure 5A:
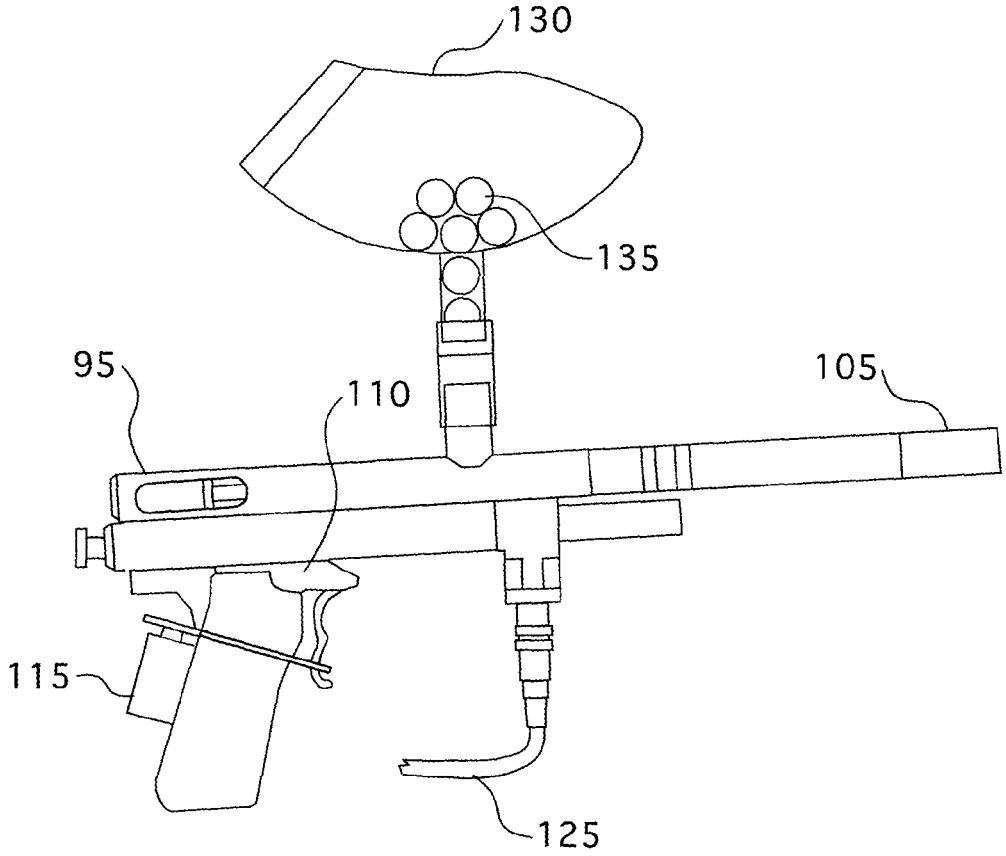
FIG. 5A shows a pneumatic projectile launcher for use with the remotely-controlled vehicle according to various embodiments of the present invention.

As shown in FIGS. 1-3 and in FIG. 5, the pneumatic projectile launcher 95 may comprise a barrel 105, a receiver assembly 110 connected to the barrel 105 and comprising a pneumatic valve (not shown) and a pneumatic valve actuator 115, a pressurized gas cartridge 120 connected to the receiver assembly 115 via a flexible pneumatic supply line 125, and a projectile magazine 130 for storing projectiles 135 and feeding the projectiles 135 into the receiver assembly 115. Operation of the pneumatic projectile launcher 95 may be such that activation of the pneumatic valve actuator 115 causes a pulse of compressed gas from the pressurized gas cartridge 120 to be discharged into the receiver assembly 115 via the pneumatic valve. A projectile 135 previously fed into the receiver assembly 115 from the projectile magazine 130 may thus be forcibly discharged from the barrel 105. The range of the projectile 135 may be controlled, for example, by regulating the pressure in the pressurized gas cartridge 120 and/or by controlling the pneumatic valve actuator 115 in order to vary the duration of the compressed gas pulse. The pneumatic valve actuator 115 may be connected to the control circuit 75, thus enabling the operation of the pneumatic projectile launcher 95 to be controlled remotely by using a controller, such as radio control device 80.

The mounting assembly 100 may comprise a pivot joint 140, at least one electro-mechanical servo 145 mechanically coupled to the pneumatic projectile launcher 95 via a corresponding linkage assembly 150, and a mounting bracket 155 anchored to the chassis of the RC vehicle 10 for providing an adjustable mounting point for the servo 145. The pivot joint 140 may be affixed to an adjustable support rod 142, and the adjustable support rod may be adjustably fastened to the mounting bracket 155. The linkage assembly 150 may comprise one or more adjustable-length pushrods 160 for transferring mechanical force generated by the servo 145 to the pneumatic projectile launcher 95, thereby enabling its movement about the pivot joint 140 in the desired manner. According to various embodiments, the mounting assembly 100 may be configured such that operation of the servo 145 allows the trajectory of the pneumatic projectile launcher 95 to be continuously varied in a vertical plane. Alternatively, the mounting assembly 100 may be configured such that the trajectory of the pneumatic projectile launcher 95 may be continuously varied in a horizontal plane. According to other embodiments, the mounting assembly 100 may be configured such that the trajectory of the pneumatic projectile launcher 95 may be continuously varied in both the vertical and horizontal planes, thus proving three-dimensional trajectory control. In such embodiments, the mounting assembly 100 may further comprise an additional servo (not shown) and corresponding linkage assembly (not shown) for controlling the trajectory of the pneumatic projectile launcher 95 in the second plane. In each of the mounting assembly 100 embodiments, the at least one servo 145 may be connected to the one or more receivers comprising the control circuit 75, thus enabling control of the pneumatic projectile launcher 95 trajectory using the radio control device 80.

Although the pneumatic projectile launcher 95 is shown in FIGS. 1-3 as being mounted on the right side of the RC vehicle 10 and parallel therewith, it can be appreciated that alternative mounting positions may also be used. For example, the pneumatic projectile launcher 95 may be mounted on top of the RC vehicle 10 or on the left side thereof. For certain mounting positions, it may be necessary to mechanically limit the movement of the pneumatic projectile launcher 95 in one or more directions in order to prevent the pneumatic projectile launcher 95 from impinging on other components comprising the RC vehicle 10. In one embodiment, the mounting bracket may be in the form of a clevis having a pin positioned between two opposing sides thereof with the projectile launcher mounted to the clevis through the pin to allow movement of the projectile launcher through one plane. The clevis may be rotationally mounted to the vehicle to define an axis of rotation. Thus, the projectile launcher, by rotation of the clevis, may rotate about the axis of rotation while at the same time being moves about the pin of the clevis so that the projectile launcher can be positioned in any of a number of multiple angles in the plane between the ends of the clevis and in any position about the axis of rotation.

Figure 5B:
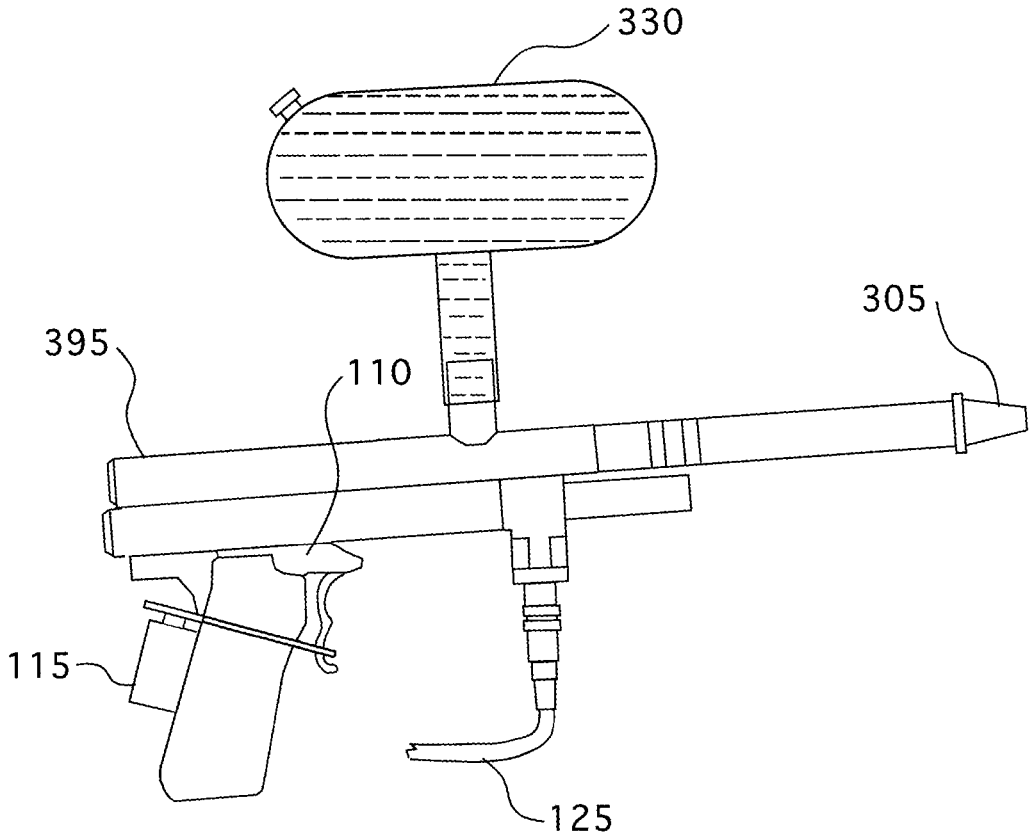
FIG. 5B shows a pneumatic water cannon for use with the remotely-controlled vehicle according to various embodiments of the present invention.

As an alternative to the pneumatic projectile launcher 95, the RC vehicle 10 may comprise a water cannon 395 for shooting streams of water in an intermittent or continuous fashion using a compressed gas. As shown in FIG. 5B, the water cannon 395 may comprise a reservoir 330 for storing water in place of the magazine 130 and a hand-operated air pump 115 for pressurizing the reservoir 330 prior to use of the water cannon 395. As an alternative to the hand-operated pump 115, the water cannon may comprise a pressurized gas cartridge similar to that described above in connection with the pneumatic projectile launcher 95 for providing reservoir pressurization. Release of the water from the pressurized reservoir may be controlled using a water valve. An electro-mechanical servo in communication with the one or more receivers comprising the control circuit 75 may operate the water valve in accordance with control commands transmitted from the radio control device 80. A barrel attached to the water valve and comprising an adjustable nozzle 305 may be used to shape and direct the water stream in the desired manner. A mounting assembly identical to that described above in connection with the pneumatic projectile launcher system 15 may be used to affix the water cannon to the RC vehicle 10 and to control the trajectory of its water stream.

According to other embodiments, the RC vehicle 10 may further comprise a laser pointer (not shown) and one or more laser sensors (not shown). The laser pointer may be, for example, a low wattage to reduce the risk of unintended injuries. The control circuit 80 may be connected to the laser pointer and configured to energize the laser pointer in accordance with control commands transmitted from the radio control device 80. The control circuit 75 may also be connected to the one or more laser sensors and configured such that when a laser "hit" from a remote laser pointer (e.g., from a similarly equipped RC vehicle) is detected, the RC vehicle 10 is shut off or otherwise disabled for a period of time. Additionally, the control circuit 75 may be configured to provide an audible indication when a laser hit is detected and to tally the number of laser hits in order to provide a laser hit score.

According to various embodiments, the laser pointer may be affixed to the above-described pneumatic projectile launcher 95 or water cannon and used in conjunction therewith. According to other embodiments, the laser pointer may replace the pneumatic projectile launcher 95 or the water cannon and utilize their corresponding mounting assemblies. According to other embodiments, the laser pointer may be affixed to the RC vehicle 10 in a stationary manner and aimed by steering the RC vehicle 10.

The rocket launcher system 20 may comprise one or more reusable toy rockets 165, such as those manufactured by Estes-Cox Corporation of Penrose, Colo., that may be launched using expendable solid-fuel rocket motors. The rocket launcher system 20 may comprise a launch pad 170 and, for each of the one or more rockets 165, a launch rod 175 connected to the launch pad 170 for maintaining each rocket 165 in a perpendicular position relative to the launch pad 170 and for providing stability during the first moments of its launch. The rocket launcher system 20 may further comprise an electronic ignition system 180 in communication with the control circuit 75 for igniting a solid-fuel rocket motor in each of the one or more rockets 165. The electronic ignition system 180 may comprise wire igniters 185 inserted into each of the solid-fuel rocket motors and a DC voltage source 190 connected to each igniter 185 via an ignition switch 195. Each wire igniter 185 may be, for example, a length of nichrome wire, and the ignition switch 195 may be, for example, a relay ignition switch or a servo-operated ignition switch. The DC voltage source 190 may be, for example, a battery capable of supplying sufficient current to heat the wire igniter 185 to the temperature required for ignition of the solid-fuel rocket motors. The control circuit 75 may be configured to operate the ignition switch 195 in response to receiving a command signal from the radio control device 80, thus causing the ignition of each solid-fuel rocket motor by its corresponding wire igniter 185 and the subsequent launch of the one or more rockets 165 from the RC vehicle 10. For embodiments of the rocket launcher system 20 comprising more than one rocket 165, the electronic ignition system 180 may comprise an ignition switch 195 for each rocket 165, thus permitting the rockets 165 to be launched one at a time or in unison.

In order to control the trajectory of the one or more rockets 165, the rocket launcher system 20 may further comprise one or more electro-mechanical servos 200 operatively coupled to the launch pad 170. For example, as shown in FIGS. 1-3, the rocket launcher system 20 may comprise a single servo 200 configured to orient the launch pad 170 in a first plane, for example, a generally vertical plane, while maintaining a fixed position in other planes, for example, a horizontal plane and other vertical or sloped planes. In this embodiment, the launch pad 170 is coupled to the servo 200 by a pivot joint 172, such as a clevis and pin mounted joint or any other suitable known joint. The joint 172 allows the rocket launcher to move the rockets, for example, from a substantially vertical position in a first vertical plane forward of the vehicle and down to a substantially horizontal position in the first vertical plane or any position in between. The rockets can thereby be launched in any desired direction along the approximate 90° arc of the first plane. The joint 172 may additionally or alternatively, allow the rocket launcher to move from right to left relative to the vehicle, through for example, an arc of 180° or any angle in between along a second vertical plane, lying generally perpendicular to the first vertical plane.

Alternatively, the servo 200 may be configured to orient the launch pad 170 in a third plane, for example, a generally horizontal plane, while maintaining a fixed position in other planes, for example, the first and second vertical planes. The joint 172 may rotate about a shaft (not shown) powered by the servo 200, thereby moving the launch pad 170 into any desired position along the 360° path of rotation. According to other embodiments, the rocket launcher system 20 may comprise at least a second servo (not shown) and suitable joints 172 for permitting three-dimensional positional control of the launch pad 170. According to such embodiments, one servo, for example, may orient the launch pad 170 in a desired position within a first plane and the other servo may orient the launch pad 170 in a desired position in a second plane. The joint may be a universal joint or another suitable known joint that allows movement through multiple planes for greater positional flexibility.

The one or more servos 200 comprising the rocket launcher system 20 may be connected to the control circuit 75 and operated using the radio control device 80. Additionally, the rocket launcher system 20 may comprise an adjustable mounting member 205 for anchoring the rocket launcher system 20 to the RC vehicle. The adjustable mounting member 205 may permit manual adjustment or may be powered by another servo.

In order to provide safe operation of the RC vehicle 10, one or more safety interlocks 310, shown in FIG. 2, may be employed to disable operation of one or more of the armament systems under certain conditions. For example, it may be desirable to disable the launch of the one or more rockets 165 when the RC vehicle 10 is in motion or when the launch angle of the launch pad 170 is less than a predetermined value with respect to the horizontal plane. Accordingly, the RC vehicle 10 may further comprise a motion sensor 312 and an angle sensor 314 for detecting such conditions. The motion sensor 312 may comprise, for example, a ball-contact type motion switch attached to the chassis 35 of the RC vehicle 10 and having a set of switched contacts connected in series with the ignition switch 195. It will be appreciated that other types of motion switches, such as mercury-based motion switches, may also be used. The design of the motion switch may be such that the switched contacts are caused to open when the RC vehicle 10 is in motion, thus preventing the launch of the one or more rockets 165. The motion sensor 312 may include one or more additional sets of switched contacts that may be used for disabling operation of one or more of the pneumatic projectile launcher 95 and the water cannon 395 during vehicle motion. This may be accomplished, for example, by connecting the each additional set of switched contacts in series with the pneumatic valve actuator 115 and the water valve electro-mechanical servo, respectively.

The angle sensor 314 may comprise, for example, a ball-contact type tilt switch mounted to the launch pad 170 and having a set of switched contacts connected in series with the ignition switch 195. It will be appreciated that other types of angle switches, such as mercury-based tilt switches, may also be used. The design of the tilt switch may be such that the switched contacts are caused to open when the launch angle of the launch pad 170 is less than a predetermined value with respect to the horizontal plane, thus disabling the launch of the one or more rockets 165. Additional angle sensors 314 mounted on the barrels of the pneumatic projectile launcher 95 may be connected in a similar manner for disabling these armament systems based upon their firing angle with respect to the horizontal plane.

According to various embodiments, the wireless camera system 25 may comprise at least one video camera 210 and corresponding transmitter 215 for transmitting real-time video images from the vicinity of the RC vehicle 10 and a receiver 375 for receiving the video images and generating a video signal therefrom. The video camera 210, transmitter 215, and receiver 375 may be similar to those used for surveillance activities and designed for battery-powered operation. According to various embodiments, the video camera 210 may include an integral microphone (not shown) for transmitting sound with the video images. A user of the RC vehicle 10 may view the video images and listen to the accompanying audio via a video display 380 in communication with the receiver 375.

According to various embodiments, the video camera 210 may be mounted in a stationary manner to the RC vehicle 10 so as to provide an unobstructed view. In such embodiments, it may be desirable to mount the video camera 210 to the front of the RC vehicle 10 to improve navigational capabilities. Alternative stationary mounting positions for the video camera 210, however, may also be utilized. According to other embodiments, the video camera 210 may be mounted using one or more servos (not shown) connected to the control circuit 75 and operated using the radio control device 80, thus enabling the video camera 210 to be selectively oriented with respect to the RC vehicle 10. For example, a single servo may be used to control the video camera 210 orientation through a single plane by rotating the camera or allowing it to pivot. Alternatively, two servos may be used to control the video camera 210 orientation in each of at least two planes combining rotational and pivotal movement. The camera may also be mounted and powered to permit continuous or intermittent oscillation so that it pans an area of interest. According to other embodiments, the video camera 210 may be affixed to the pneumatic projectile launcher 95, the water cannon 395, or the laser pointer to enhance targeting capabilities. To permit use of the RC vehicle 10 in low-light conditions, the video camera 210 may include night vision capabilities. In addition to the night vision capabilities of the video camera 210, the RC vehicle 10 may include one or more lights (not shown) for illuminating the RC vehicle 10 and its vicinity.

Figure 7:
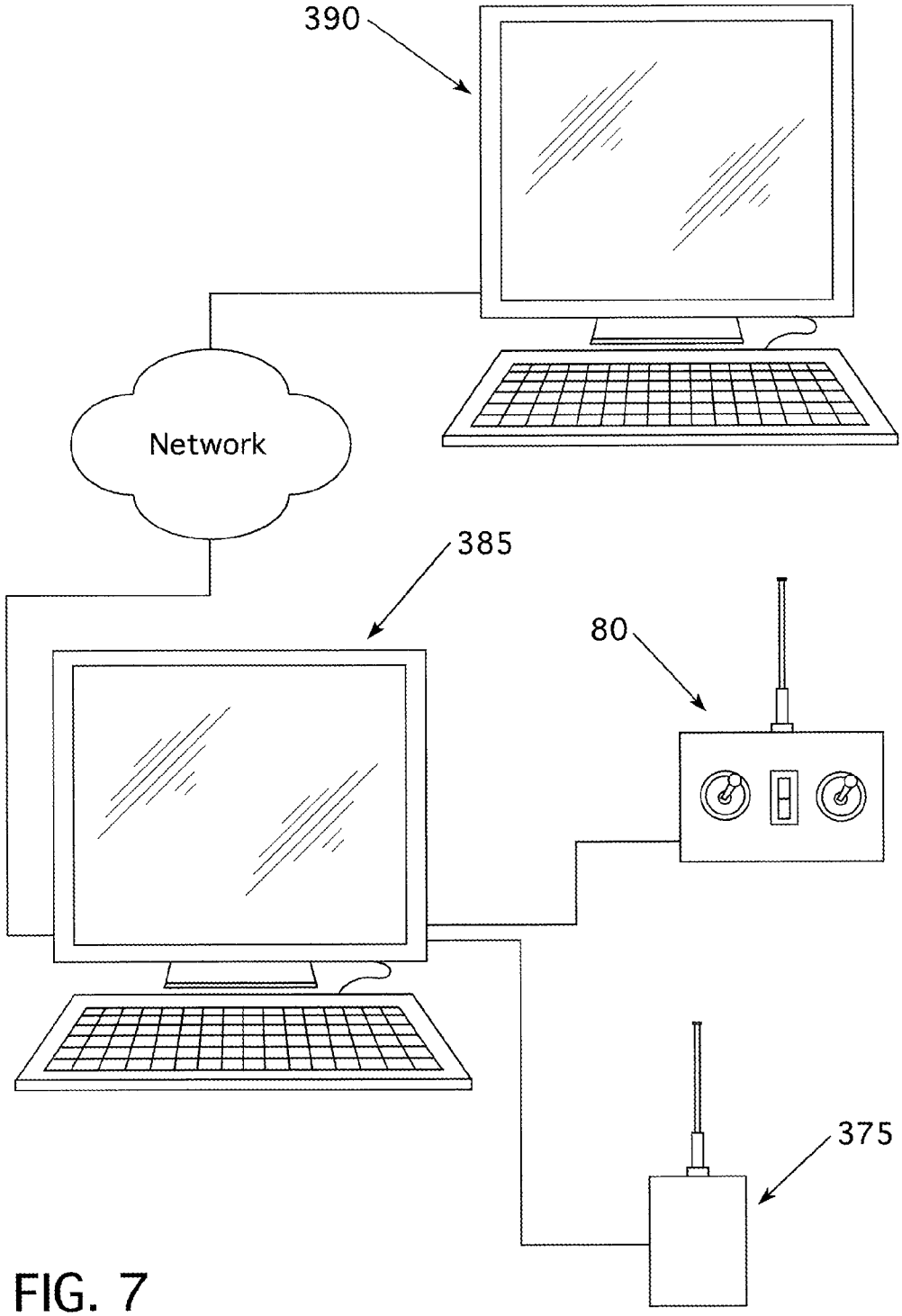
FIG. 7 shows computers and monitors for remotely controlling the RC vehicle across a network.

According to various embodiments, control of the RC vehicle 10 may be performed across a computer network, as shown in FIG. 7, such as, for example, the Internet. For example, a first computer 385 in the vicinity of the RC vehicle 10 may be configured to receive control commands from a second computer 390 associated with the operator via the network and to provide the received control commands to the RC vehicle 10 via the radio control device 80. The receiver 375 comprising the wireless camera system 25 may be in communication with the first computer 385 and provide video images captured by the video camera 210 and/or sounds detected by audio equipment from the vicinity of interest by the RC vehicle 10 to the second computer 390 via the network. A homeowner away on vacation or business may thus operate the RC vehicle 10 to monitor his home and/or its surrounding property. Similarly, vacation property may be monitored from the owner's primary residence. According to such embodiments, the first computer 385 or the radio control device 80 may be pre-programmed to automatically navigate the RC vehicle 10 about the monitored area in a predetermined manner.

For those embodiments of the RC vehicle 10 utilizing an electric motor and rechargeable batteries for propulsion, a charging station (not shown) may be provided for recharging the batteries. The charging station may comprise a transformer and rectification circuit for converting a household AC voltage into a DC voltage compatible with the charging requirements of the rechargeable batteries. The charging station may further comprise a charging plug compatible with a corresponding charging receptacle located on the RC vehicle 10. The batteries of the RC vehicle 10 may be recharged by manually positioning the RC vehicle 10 such that the charging plug is inserted into the charging receptacle. Alternatively, the batteries may be recharged from a remote location by controlling the RC vehicle 10 in a manner such that the charging receptacle is caused to engage the charging plug. In such embodiments, it may be desirable to utilize spring-loaded charging contacts on the RC vehicle 10 and charging station instead of a charging receptacle/plug arrangement in order to reduce problems arising from receptacle/plug misalignment.

Figure 6A:
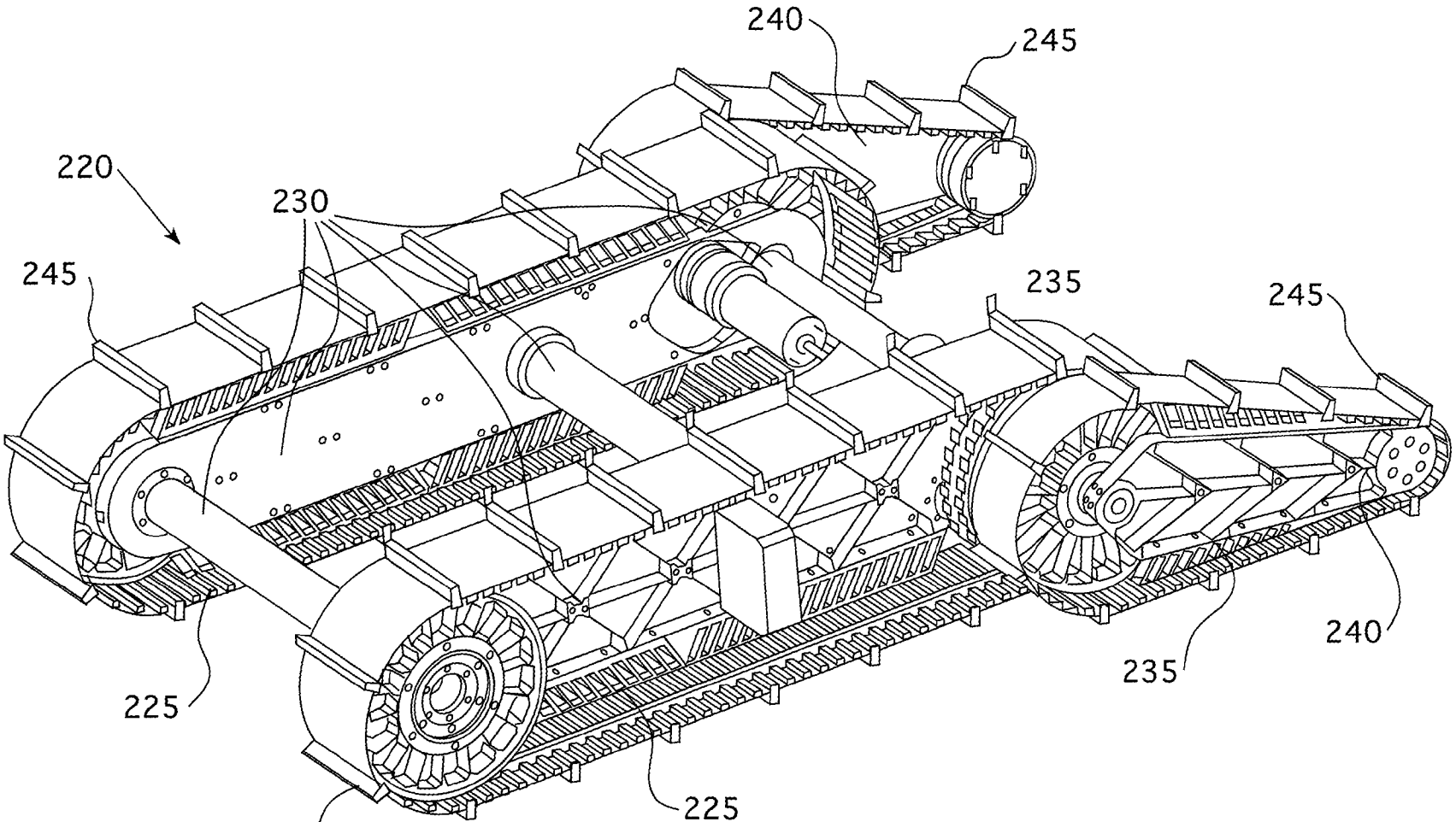
FIG. 6A shows an articulated tread assembly for use with the remotely-controlled vehicle according to various embodiments of the present invention.

FIG. 6A shows an articulated tread assembly 220 that may be used as an alternative to wheels 42, according to various embodiments. In addition to allowing the RC vehicle 10 to navigate a variety of flat and inclined terrains, the articulated tread assembly 220 permits the RC vehicle 10 to ascend and descend flights of stairs, thus providing enhanced navigational capabilities in buildings and similar environs. An example of an articulated tread assembly for providing such functionality is disclosed in U.S. Pat. No. 6,431,296, which is incorporated herein by reference in its entirety. The articulated tread assembly 220 may comprise a pair of parallel main tracks 225 attached to a main frame 230, and a pair of forward tracks 235 mounted on a pair of forward arms 240 that are pivotally attached to the main frame 230. Each of the main tracks 225 and forward tracks 235 may include a flexible continuous belt 245 attached thereto. Although not shown in FIG. 6A for the sake of clarity, the chassis 35 of the RC vehicle 10 may be attached the upper side of the main frame 230.

Figure 6B:
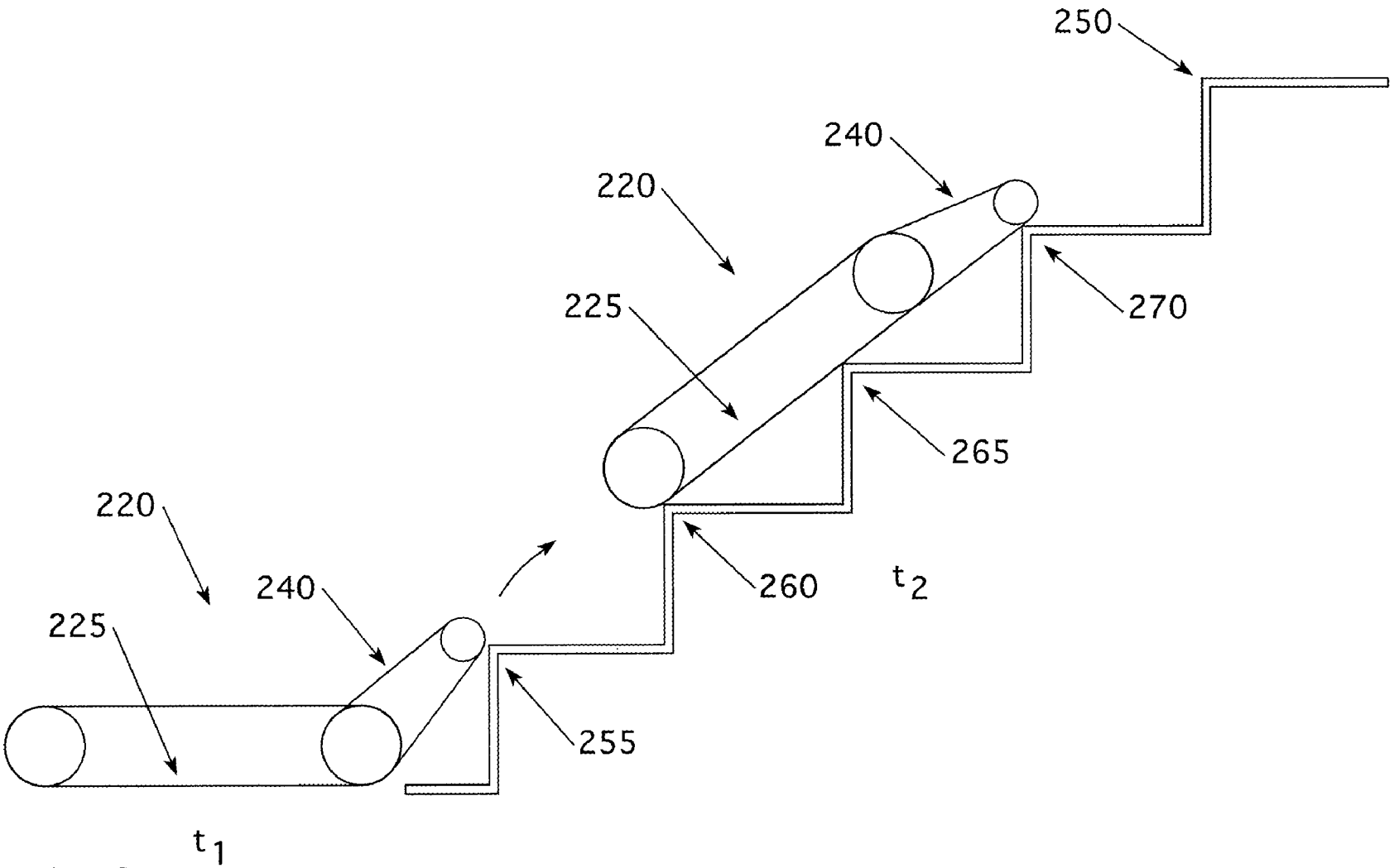
FIG. 6B shows the articulated movement of the articulated tread assembly of FIG. 6A.

FIG. 6B illustrates the articulated movement of the articulated tread assembly 220 during the ascension of a flight of stairs 250. When the first step 255 of the flight of stairs 250 is encountered at time t1, the forward arms 240 may be raised from an extended position and the RC vehicle 10 driven forward, thus causing the main tracks 225 to be raised. After the main tracks 225 are raised, the forward arms 240 may be re-extended and the RC vehicle 10 again driven forward, thereby increasing the wheel base of the RC vehicle 10 and allowing it to bridge each of the subsequent steps 260, 265, 270 at time t2.

Embodiments of the RC vehicle 10 may thus provide additional entertainment activities that are not possible with conventional RC vehicles. For example, when operated alone, the RC vehicle 10 may be used for a variety of competitive target-shooting activities, including paintball. When operated in conjunction with one or more similarly-equipped RC vehicles, the operator of the RC vehicle 10 may engage other vehicle operators in mock battles at a location remote from the operator.

Embodiments of the RC vehicle 10 may also be used to perform various surveillance or law enforcement tasks. In addition to the eavesdropping capabilities provided by the wireless camera system 25, the pneumatic projectile launcher 95 may be used with phosphor-filled paintballs in order to "tag" persons and/or vehicles with markers that are imperceptible to the naked eye in normal light, but visible, for example, in UV light.

Whereas particular embodiments of the invention have been described herein for the purpose of illustrating the invention and not for the purpose of limiting the same, it will be appreciated by those of ordinary skill in the art that numerous variations of the details, materials, configurations and arrangement of parts may be made within the principle and scope of the invention without departing from the spirit of the invention.

What is claimed is:

1. A remotely-controlled toy vehicle comprising:

a toy vehicle;

a paintball launcher;

a mounting assembly for pivotally mounting the paintball launcher to the vehicle for movement through at least one plane;

a rocket launcher for launching reusable toy rockets mounted to the vehicle for movement through at least one plane;

a container for holding a plurality of paintballs;

a controller for remotely controlling the movement of the vehicle, the paintball launcher and the rocket launcher; and a safety interlock system comprising at least one of a motion detector and an angle detector for disabling said launchers unless predetermined conditions are detected.

2. The remotely controlled vehicle of claim 1 wherein the paint balls comprise colored paint encapsulated in a shell structured to fragment upon impact.

3. The remotely controlled vehicle of claim 1 wherein the paint balls comprise phosphor paint encapsulated in a shell structured to fragment upon impact.

4. A remotely-controlled toy vehicle comprising:

a toy vehicle;

at least one projectile launcher;

a mounting assembly for pivotally mounting the projectile launcher to the vehicle for movement through at least one plane;

a rocket launcher for launching reusable toy rockets mounted to the vehicle for movement through at least one plane;

a controller for remotely controlling the movement of the vehicle, the projectile launcher and the rocket launcher; wherein said projectile launcher is structured to launch solid projectiles made of a soft material selected from the group consisting of foam, sponge, cloth and soft plastic, and said vehicle further comprises a container connected to said projectile launcher for holding a plurality of said solid projectiles; and, a safety interlock system comprising at least one of a motion detector and an angle detector for disabling said launchers unless predetermined conditions are detected.

5. The remotely controlled vehicle of claim 4 further comprising at least one camera system mounted to the vehicle comprising a camera for capturing images, said camera being controllable by said controller.

6. The remotely controlled vehicle of claim 5 wherein said camera is a video camera and said camera system further comprises a transmitter for transmitting said captured images to a remote receiver.

7. The remotely controlled vehicle of claim 6 further comprising a video display for remotely viewing the captured images transmitted to said receiver.

8. The remotely controlled vehicle of claim 4 wherein the rocket launcher has one or more launchable reusable toy rockets, each reusable toy rocket including at least one solid-propellant rocket motor.

9. A remotely-controlled toy vehicle comprising:

a toy vehicle;

at least one projectile launcher;

a mounting assembly for pivotally mounting the projectile launcher to the vehicle for movement through at least one plane;

a rocket launcher for launching reusable toy rockets mounted to the vehicle for movement through at least one plane;

a controller for remotely controlling the movement of the vehicle, the projectile launcher and the rocket launcher; and at least one safety interlock system comprising at least one of a motion detector and an angle detector for disabling the operation of said projectile launcher and said rocket launcher unless predetermined conditions are detected.

10. The remotely controlled vehicle of claim 9 wherein said projectile launcher is structured to launch one of a stream of liquid or solid projectiles.

11. A remotely-controlled toy vehicle comprising:

a toy vehicle and, mounted thereto, at least two enhancements selected from the group consisting of a projectile launcher, a rocket launcher for launching reusable toy rockets, a water cannon, and a camera system;

at least one mounting assembly for pivotally mounting at least one enhancement to the vehicle for movement through at least one plane;

a controller for remotely controlling the movement of the vehicle and the operation of said enhancements; and, a safety interlock system comprising at least one of a motion detector and an angle detector for disabling at least one of said enhancements unless predetermined conditions are detected.

12. A remotely-controlled toy vehicle comprising:

a toy vehicle and, mounted thereto, a projectile launcher for launching projectiles selected from the group consisting of paintballs, foam projectiles, sponge projectiles, cloth projectiles and soft plastic projectiles;

a mounting assembly for pivotally mounting the projectile launcher to the vehicle for movement through at least one plane;

a camera system;

a first container connected to the projectile launcher for holding a plurality of projectiles;

a controller for remotely controlling the movement of the vehicle and the operation of said projectile launcher, and said camera system; and, a safety interlock system comprising at least one of a motion detector and an angle detector for disabling at least said projectile launcher unless predetermined conditions are detected.

13. The vehicle recited in claim 12 further comprising:

a rocket launcher for launching reusable toy rockets mounted to said vehicle for movement through at least one plane.

14. The remotely controlled vehicle of claim 12 wherein said camera system comprises:

a video camera for capturing images, said camera being controllable by said controller;

a transmitter for transmitting said captured images to a remote receiver; and, a video display for remotely viewing the captured images transmitted to said receiver.

* * * * *